US008437487B2

(12) United States Patent
Munk

(10) Patent No.: US 8,437,487 B2
(45) Date of Patent: May 7, 2013

(54) METHOD FOR SUPPRESSING ACOUSTIC FEEDBACK IN A HEARING DEVICE AND CORRESPONDING HEARING DEVICE

(75) Inventor: Steen Michael Munk, Smørum (DK)

(73) Assignee: Oticon A/S, Smorum (DK)

( * ) Notice: Subject to any disclaimer, the term of this patent is extended or adjusted under 35 U.S.C. 154(b) by 169 days.

(21) Appl. No.: 13/016,412

(22) Filed: Jan. 28, 2011

(65) Prior Publication Data

US 2011/0188686 A1 Aug. 4, 2011

Related U.S. Application Data

(60) Provisional application No. 61/300,049, filed on Feb. 1, 2010.

(30) Foreign Application Priority Data

Feb. 1, 2010 (EP) ..... 10152253

(51) Int. Cl.
*H04R 25/00* (2006.01)

(52) U.S. Cl.
USPC ..... 381/318; 381/312; 381/317

(58) Field of Classification Search ..... 381/312, 381/317–318, 320, 93
See application file for complete search history.

(56) References Cited

U.S. PATENT DOCUMENTS

| | | | |
|---|---|---|---|
| 5,170,434 | A | 12/1992 | Anderson |
| 6,912,289 | B2 | 6/2005 | Vonlanthen et al. |
| 2007/0280494 | A1 | 12/2007 | Hamacher |
| 2008/0063230 | A1 | 3/2008 | Gao et al. |

FOREIGN PATENT DOCUMENTS

| | | |
|---|---|---|
| EP | 1203510 B1 | 6/2006 |

OTHER PUBLICATIONS

Johan Hellgren., "Analysis of Feeback Cancellation in Hearing Aids With Filtered-X LMS and the Direct Method of Closed Loop Identificaion", IEEE Transactions on Speech and Audio Processing, vol. 10, No. 2, Feb. 2002, pp. 119-131, ISSN: 1063-6676.

*Primary Examiner* — Suhan Ni
(74) *Attorney, Agent, or Firm* — Birch, Stewart, Kolsach & Birch, LLP

(57) ABSTRACT

A hearing device (HD) incorporates a method for adaptive cancellation of acoustic feedback (AF). The method comprises generating an estimated feedback signal (EF) and subtracting the estimated feedback signal (EF) from the microphone signal (MS) before feeding it to a signal processor (SP) providing the primary hearing device function. The estimated feedback signal (EF) is generated in an adaptive filter (FE1), which is controlled using a least-mean-square algorithm, which operates on an error signal (E) and a reference signal (R). The algorithm may behave erroneously if the feedback path changes while a signal with low HF content, such as speech, is received. In this case, the hearing device (HD) will not be able to quickly adapt the HF characteristic of the adaptive filter (FE1) to the changed conditions. The adaptive filter (FE1) may thus have an incorrect HF gain when a subsequent signal with high HF content is received. This may lead to whistling or, alternatively, to an unwanted suppression of the subsequent signal. The problem is solved by modifying a filter function (H) applied to the error signal (E) and to the reference signal (R) in dependence on estimated relative amounts of high- and low-frequency signal content in the microphone signal (MS).

22 Claims, 2 Drawing Sheets

METHOD FOR SUPPRESSING ACOUSTIC FEEDBACK IN A HEARING DEVICE AND CORRESPONDING HEARING DEVICE

CROSS REFERENCE TO RELATED APPLICATIONS

This non-provisional application claims the benefit of U.S. Provisional Application No. 61/300,049 filed on Feb. 1, 2010 and to U.S. patent application Ser. No. 10152253.0 filed in European Patent Office on Feb. 1, 2010. The entire contents of all of the above applications is hereby incorporated by reference.

TECHNICAL FIELD

The present invention relates to a method for suppressing acoustic feedback in a hearing device and to a hearing device adapted to executing such a method. More specifically, the present invention relates to a method for cancelling acoustic feedback signals in an electronic hearing device, such as e.g. a hearing aid or a listening device, which receives acoustic signals from a person's surroundings, modifies the acoustic signals electronically and transmits the modified acoustic signals into the person's ear or ear canal, and to a hearing device adapted to executing the method.

The invention may e.g. be useful in applications such as a hearing aid for compensating a hearing-impaired person's loss of hearing capability or a listening device for augmenting a normal-hearing person's hearing capability.

BACKGROUND ART

European Patent EP 1 203 510 to Nielsen et al. discloses a method of canceling feedback in an acoustic system, such as a hearing aid. An acoustic signal is received by a microphone, amplified and filtered in an amplifier and subsequently transmitted by a speaker. A portion of the speaker output undesirably returns to the microphone via an acoustic feedback path, e.g. through a vent in the hearing aid. The microphone thus outputs a feedback signal along with the signal received from the environment. The microphone, the amplifier, the speaker and the feedback path together form a feedback loop. Depending on gains and phase shifts in the feedback loop, audible artifacts, such as whistles, may be generated. In order to suppress such artifacts that may be very annoying to e.g. a user of a hearing aid, the input to the speaker is also fed to an adaptive filter, which emulates the portion of the feedback loop formed by the speaker, the feedback path and the microphone. The output of the adaptive filter is thus an estimate of the feedback signal, and in order to cancel the feedback, the estimated feedback signal is subtracted from the microphone output before it is fed to the amplifier. Thus, ideally, only the signal received from the environment reaches the amplifier. The transfer function of the adaptive filter is controlled by a set of filter coefficients, which is updated repeatedly using a so-called least-mean-square (LMS) algorithm as already well known in the art. The LMS algorithm receives a delayed version of the speaker input as a reference signal and the amplifier input as an error signal and attempts to determine the filter coefficients so that the estimated feedback signal resembles the actual feedback signal. The delay ideally corresponds to the delay in the emulated portion of the feedback loop. The disclosed invention solves the problem that the stability of the feedback loop emulation decreases when the microphone receives signals with long autocorrelation functions from the environment, e.g. low-frequency (LF) tones.

The disclosed invention achieves its object by feeding only a high-frequency (HF) range of the reference and error signals to the algorithm. The HF range preferably includes those frequency ranges, in which feedback-caused artifacts are expected to occur. In order to avoid a deterioration of the filter characteristic in the remaining LF range, the LF range of the reference signal is replaced with an LF noise signal, and the LF range of the error signal is permanently set to zero.

DISCLOSURE OF INVENTION

Thorough analysis of the method described above as well as measurements on hearing devices incorporating the method have shown that the adaptive filter may behave erroneously in specific situations, e.g. during reception of speech signals, which it is normally desired to process with the best possible quality. The reason for the erroneous behaviour is that the adaptation speed decreases when the signal amplitude decreases. If the feedback path changes while a signal with low HF content, such as speech, is received, then the hearing device will not be able to quickly adapt the HF characteristic of the adaptive filter to the changed conditions. The adaptive filter may thus have an incorrect HF gain when a subsequent signal with high HF content is received. This may lead to whistling or, alternatively, to an unwanted suppression of the HF portion of the subsequent signal.

It is an object of the present invention to provide a method to overcome the above problem. It is a further object of the present invention to provide a hearing device adapted to overcome the above problem.

Objects of the invention are achieved by the invention described in the accompanying independent claims and as described in the following. Further objects of the invention are achieved by the embodiments defined in the dependent claims and in the detailed description of the invention.

It is intended that the structural features of the system described below, in the detailed description of "mode(s) for carrying out the invention" and in the claims can be combined with any methods disclosed herein, when appropriately substituted by a corresponding process. Embodiments of such methods have the same advantages as the corresponding systems.

As used herein, the singular forms "a", "an", and "the" are intended to include the plural forms as well (i.e. to have the meaning "at least one"), unless expressly stated otherwise. It will be further understood that the terms "has", "includes", "comprises", "having", "including" and/or "comprising", when used in this specification, specify the presence of stated features, integers, steps, operations, elements and/or components, but do not preclude the presence or addition of one or more other features, integers, steps, operations, elements, components and/or groups thereof. As used herein, the term "and/or" includes any and all combinations of one or more of the associated listed items. The steps of any method disclosed herein do not have to be performed in the exact order disclosed, unless expressly stated otherwise.

BRIEF DESCRIPTION OF DRAWINGS

The invention will be explained in more detail below in connection with preferred embodiments and with reference to the drawings in which.

The figures are schematic and simplified for clarity, and they just show details, which are essential to the understanding of the invention, while other details are left out. Throughout, the same reference numerals and names are used for identical or corresponding parts.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

MODE(S) FOR CARRYING OUT THE INVENTION

Figure 1:
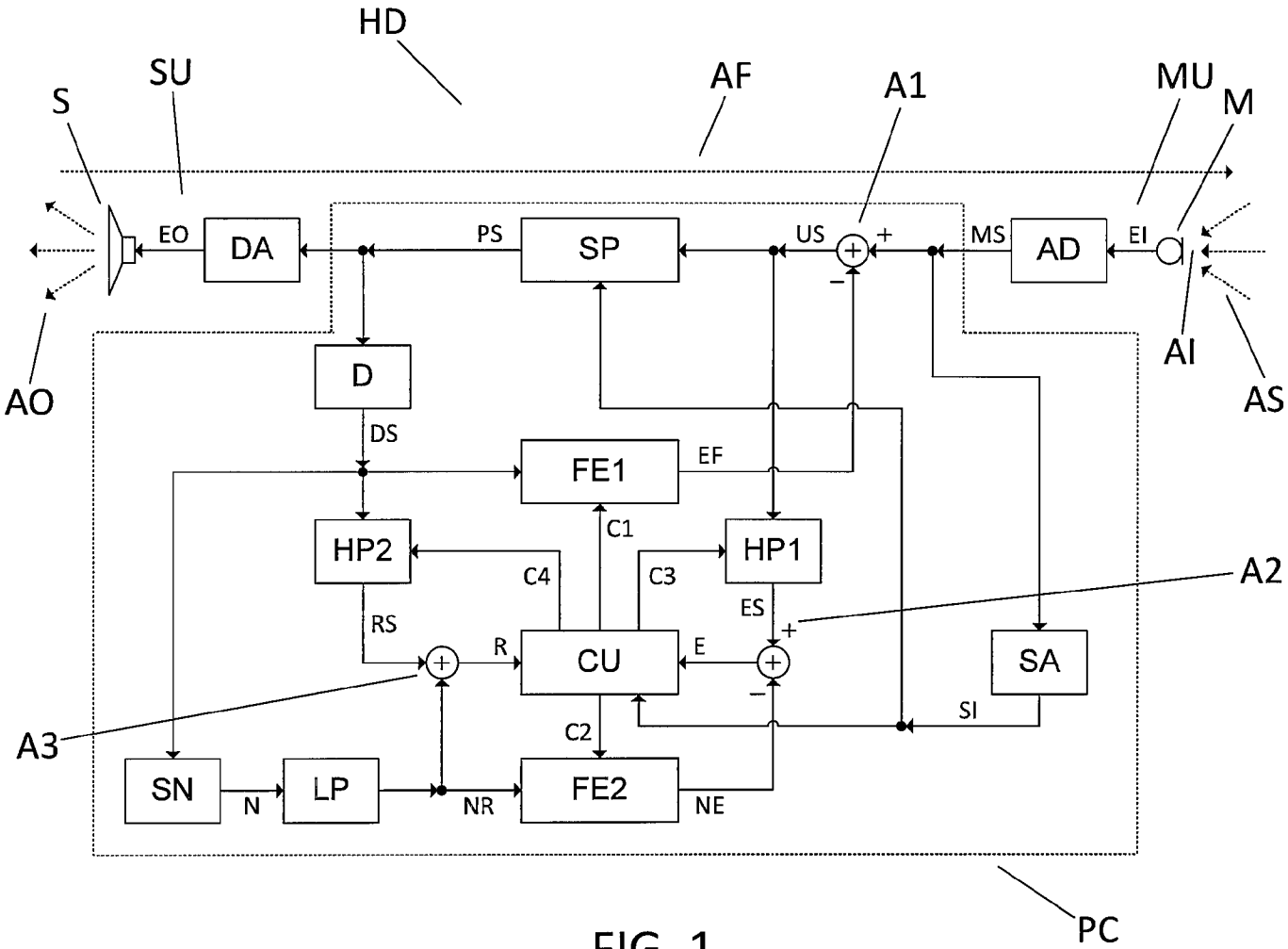
FIG. 1 shows a first embodiment of a hearing device according to the present invention.

FIG. 1 shows a first embodiment of a hearing device HD according to the invention. The hearing device HD comprises a microphone unit MU, processing circuitry PC and a speaker unit SU. The microphone unit MU comprises a microphone M and an analog-to-digital converter AD. The microphone M is arranged to receive an acoustic input signal AI comprising ambient sounds AS from the environment as well as acoustic feedback AF of an acoustic output signal AO and is adapted to convert the acoustic input signal AI into an electric input signal EI in analog form. The analog-to-digital-converter AD is connected to receive the electric input signal EI and is adapted to digitise the electric input signal EI as well as to provide the result as a microphone signal MS in digital form. The processing circuitry PC is connected to receive the microphone signal MS and is adapted to provide a processed signal PS. The speaker unit SU comprises a digital-to-analog converter DA and a speaker S. The digital-to-analog converter DA is connected to receive the processed signal PS in digital form and is adapted to convert it into an electric output signal EO in analog form. The speaker S is connected to receive the electric output signal EO, is adapted to convert it into the acoustic output signal AO and is arranged to radiate the acoustic output signal AO into a user's ear canal.

The processing circuitry PC comprises three adders A1, A2, A3, a signal processor SP, a delay element D, two estimation filters FE1, FE2, two high-pass filters HP1, HP2, a Schroeder-noise generator SN, a low-pass filter LP, a signal analyser SA and a control unit CU. The first adder A1 is connected to receive the microphone signal MS on a first input as well as an estimated feedback signal EF on a second input and is adapted to subtract the estimated feedback signal EF from the microphone signal MS as well as to provide the result as an unprocessed signal US. The signal processor SP is connected to receive the unprocessed signal US as well as a spectrum information signal SI and is adapted to provide the processed signal PS. The delay element D is connected to receive the processed signal PS and is adapted to delay the processed signal PS as well as to provide the result as a delayed signal DS. The first estimation filter FE1 is connected to receive the delayed signal DS as well as a first control signal C1 and is adapted to provide the estimated feedback signal EF.

The second estimation filter FE2 is connected to receive a noise reference signal NR as well as a second control signal C2 and is adapted to provide a noise error signal NE. The first high-pass filter HP1 is connected to receive the unprocessed signal US as well as a third control signal C3 and is adapted to provide a main error signal ES. The second adder A2 is connected to receive the main error signal ES on a first input as well as the noise error signal NE on a second input and is adapted to subtract the noise error signal NE from the main error signal ES as well as to provide the result as a combined error signal E. The second high-pass filter HP2 is connected to receive the delayed signal DS as well as a fourth control signal C4 and is adapted to provide a main reference signal RS. The third adder A3 is connected to receive the main reference signal RS on a first input as well as the noise reference signal NR on a second input and is adapted to add the main reference signal RS to the noise reference signal NR as well as to provide the result as a combined reference signal R. The Schroeder-noise generator SN is connected to receive the delayed signal DS and is adapted to provide a noise signal N. The low-pass filter LP is connected to receive the noise signal N and is adapted to provide the noise reference signal NR.

The signal analyser SA is connected to receive the microphone signal MS and is adapted to provide the spectrum information signal SI. The control unit CU is connected to receive the combined reference signal R, the combined error signal E as well as the spectrum information signal SI and is adapted to provide the four control signals C1, C2, C3, C4.

Figure 2:
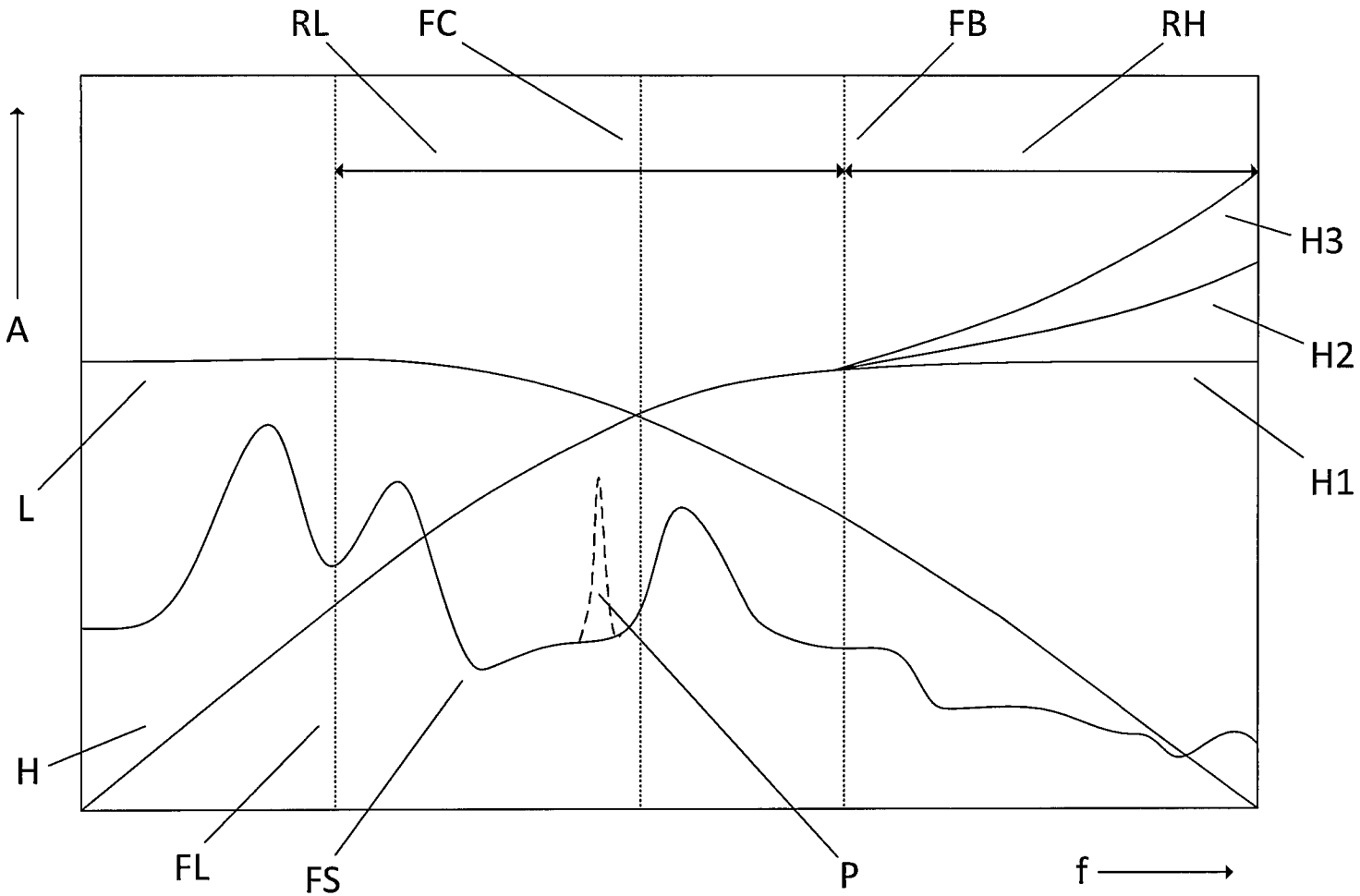
FIG. 2 shows example frequency characteristics illustrating the function of the hearing device of FIG. 1.

The diagram in FIG. 2 illustrates example frequency characteristics of the hearing device HD shown in FIG. 1. Frequency f is increasing rightwards, and amplitude or gain A is increasing upwards in the diagram. The curve FS is an example of a frequency spectrum of the microphone signal MS. The dotted curve P shows a narrow peak in the frequency spectrum FS. The frequency axis comprises two denoted frequency ranges, an LF range RL between a lower-limit frequency FL and a boost frequency FB, and an HF range RH above the boost frequency FB. A cut-off frequency FC divides the frequency axis into an LF and an HF passband. The curve L is an example transfer function of the low-pass filter LP, which has a passband equal to the LF passband. The curve H is an example transfer function of the high-pass filters HP1, HP2, which have passbands equaling the HF passband. The transfer function H of the high-pass filters HP1, HP2 is shown with three different boosts H1, H2, H3 in the HF range RH.

In the following, the function of the first embodiment of a hearing device HD is explained with reference to FIGS. 1 and 2. The signal processor SP applies amplification, attenuation, frequency filtering, amplitude compression, amplitude expansion, noise suppression and/or other modifications to the unprocessed signal US in order to provide a processed signal PS, which enables the hearing device HD to compensate for a hearing-impaired person's loss of hearing capability and/or to augment a normal-hearing person's hearing capability. Such modifications and combinations hereof are well known in the art pertaining to hearing aids and listening devices, and any of these may be implemented.

The microphone unit MU, the signal processor SP and the speaker unit SU together form a primary signal path, which is typically calibrated or adjusted to provide specific frequency- and/or level-dependent gains between the acoustic input signal AI and the acoustic output signal AO. Such gains may vary over time, depending e.g. on user settings and/or on characteristics of the received ambient sounds AS. A portion of the acoustic output signal AO undesirably returns as acoustic feedback AF to the microphone M via an acoustic feedback path, e.g. through a vent in the hearing device HD. The primary signal path and the acoustic feedback path together form a feedback loop. The microphone M thus receives both the acoustic feedback AF and the ambient sounds AS, and depending on the gains and phase shifts in the feedback loop, audible artifacts may be generated. The purpose of the processing circuitry PC—except for the signal processor SP—is to adaptively suppress such artifacts by estimating the feedback and subtracting the estimated feedback from the microphone signal MS before it is fed to the signal processor SP. Thus, ideally, only the ambient sounds AS reach the signal processor SP.

The delay element D and the first estimation filter FE1 form a cancellation path, which emulates the portion of the feedback loop formed by the speaker unit SU, the feedback path and the microphone unit MU. The total time delay in the cancellation path D, FE1 is designed to correspond to the delay in the emulated portion of the feedback loop. This delay is typically constant and well known. The transfer function, i.e. the frequency characteristic, of the first estimation filter FE1 is adaptively adjusted to reflect the phase and amplitude modifications that the processed signal PS undergoes on its way through the emulated portion of the feedback loop. This is explained in further detail below. The cancellation path D, FE1 receives the processed signal PS, and the output of the cancellation path D, FE1, i.e. the estimated feedback signal EF, is thus an estimate of the feedback as it occurs in the microphone signal MS. The first adder A1 subtracts the estimated feedback signal EF from the microphone signal MS. Thus, ideally, the feedback is canceled in the resulting unprocessed signal US, which is fed to the signal processor SP.

The remaining components A2, A3, FE2, HP1, HP2, SN, LP, SA, CU of the processing circuitry PC serve the purpose of adaptively adjusting the transfer function of the first estimation filter FE1 to match the emulated portion of the feedback loop as closely as possible. The signal analyser SA has further purposes as described further below. The first estimation filter FE1 is implemented as a finite-impulse-response (FIR) filter and the transfer function is controlled by a set of filter coefficients contained in the first control signal C1 provided by the control unit CU. The control unit CU continuously computes and updates the filter coefficients in dependence on an error signal E derived from the unprocessed signal US and on a reference signal R derived from the processed signal PS. The reference signal R is based on the delayed signal DS, which is delayed by substantially the same time delay as occurs in the emulated portion of the feedback loop. A feedback comprised in the error signal E may therefore be detected by computing the immediate correlation between the error signal E and the reference signal R, i.e. the correlation with no time shift between the signals E, R. The control unit CU computes the new filter coefficients according to an LMS algorithm, which operates to minimise the immediate correlation between the error signal E and the reference signal R. Such algorithms are well known in the art.

In known hearing devices, feedback mainly occurs at high frequencies, due to the typical characteristics of the feedback loop. In principle, it therefore suffices to feed only the high frequencies of the error and reference signals E, R to the control unit CU. Accordingly, the unprocessed signal US and the delayed signal DS are high-pass filtered in the identical first and second high-pass filters HP1, HP2 having identical transfer functions H. The passband of the high-pass filters HP1, HP2 preferably includes those frequencies, at which feedback-caused artifacts are expected to occur. At least for low frequencies, this reduces the problem that signals with long autocorrelation functions, such as pure tones, comprised in the ambient sounds AS may falsely be treated as feedback-caused artifacts and thus may lead to an erroneous adjustment of the transfer function of the estimation filter FE1. The distinction between high and low frequencies in this respect depends on the acoustic gain of the hearing device, i.e. the gain between the acoustic input signal AI and the acoustic output signal AO, since the lower limit of the frequency range in which feedback-caused artifacts occur, shifts downwards with increasing gain.

In the absence of LF input to the control unit CU, however, the transfer function of the first estimation filter FE1 might uncontrollably "run away" and thus provide erroneous estimates of the LF feedback. In order to avoid this, LF input to the control unit CU is provided by an LF control path comprising the Schroeder-noise generator SN, the low-pass filter LP and the second estimation filter FE2. The Schroeder-noise generator SN generates the noise signal N by inverting random samples of the delayed signal DS and thereby ensures that the frequency spectrum of the noise signal N resembles that of the delayed signal DS. The transfer function L of the low-pass filter LP has a cut-off frequency FC equal to or close to that of the high-pass filters HP1, HP2. The frequency spectrum of the combined reference signal R thus resembles the frequency spectrum of the processed signal PS. The noise reference signal NR is filtered in the second estimation filter FE2. The second estimation filter FE2 is implemented in the same way as the first estimation filter FE1, and the control signals C1, C2 to the two estimation filters FE1, FE2 are identical. The transfer functions of the two estimation filters FE1, FE2 are thus also identical. Desirably, the transfer function is controlled so that the output of the second estimation filter FE2, i.e. the noise error signal NE, equals zero, in which case also the LF output of the first estimation filter FE1 equals zero. Since the combined error signal E comprises the noise error signal NE, the control unit CU inherently adjusts the filter coefficients in the desired direction.

An inherent property of the LMS algorithm is that it provides faster adaptation with increasing signal level. The effect applies to individual signal frequencies as well. In order to allow fast adaptation of the estimation filters FE1, FE2 in the HF range RH when signals with low HF content, such as speech, are received, the hearing device HD is adapted to dynamically modify the transfer function H of the high-pass filters HP1, HP2 to provide a variable boost H1, H2, H3 of signal frequencies above the boost frequency FB. The variable boost H1, H2, H3 thus provides a compensation of HF roll-off in the received signal. The high-pass filters HP1, HP2 are implemented as identical infinite-impulse-response (IIR) filters. The third and fourth control signals C3, C4 are identical and each controls the transfer function H of the respective high-pass filter HP1, HP2 by selectively enabling one of a predefined number of filter coefficient sets. The signal analyser SA repeatedly computes frequency spectra FS of the microphone signal MS and provides the spectra FS in the spectrum information signal SI. The control unit CU uses the received spectra FS to repeatedly compute a power ratio between the signal power in the HF range RH and the signal power in the LF range RL. The computed power ratio thus reflects the relative amounts of high- and low-frequency signal content in the microphone signal MS. The control unit CU compares the computed power ratio with a set of thresholds, and depending on the comparison places a vote for a specific one of the filter coefficient sets, thereby determining a desired value of the transfer function H of the first and second high-pass filters HP1, HP2. The control unit CU adds the votes for a predefined number of consecutive frequency spectra FS and subsequently selects the filter coefficient set with the most votes via the third and fourth control signals C3, C4. The selection is made so that the lower the power ratio is, i.e. the lower the relative amount of HF signal content is, the higher the boost H1, H2, H3 is, and vice versa. In other words, the HF gain of the first and second high-pass filters HP1, HP2 is increased when the relative amount of HF signal content decreases. This allows the control unit CU to adapt the transfer function of the first and second estimation filters FE1, FE2 more quickly, when the hearing device HD receives signals with low HF content. The transfer function is therefore better in accordance with the emulated portion of the feedback loop than in prior art hearing devices, and a sudden increase in HF signal content is thus handled better, i.e. it is less likely that such an increase causes artifacts or that a portion of the increased signal is unnecessarily suppressed by the adaptive feedback cancellation. This effect may be used to provide a better experience to the hearing device user by enabling less feedback-caused artifacts, by generally allowing higher HF gains between the acoustic input signal AI and the acoustic output signal AO as well as by allowing lower HF gains, a so-called squelch function, during time periods with low HF signal content in the ambient sounds AS.

The control unit CU scans the frequency spectra FS for narrow peaks P, which may indicate the presence of feedback-caused artifacts, in particular in the form of pure tones. Feedback-caused artifacts only occur when the transfer function of the two estimation filters FE1, FE2 does not match the transfer function of the emulated portion of the feedback loop, which is e.g. the case immediately after a change in the feedback loop. The presence of narrow peaks P in the frequency spectra FS thus indicates that the transfer function of the two estimation filters FE1, FE2 needs to be quickly adjusted. If such narrow peaks P are detected, the control unit CU analyses the peaks P to determine their cause. If the result of the determination shows that the cause is likely to be feedback, the control unit CU modifies the LMS algorithm to provide a faster adaptation of the transfer function, at least within a relatively narrow frequency range including the detected peak P. Consequently, the first and second estimation filters FE1, FE2 adapt quicker to the emulated portion of the feedback loop, and the feedback is quickly cancelled.

When the CU changes the filter coefficient sets via the third and fourth control signals C3, C4, it immediately thereafter disables the adaptation of the first and second estimation filters FE1, FE2 for a time period long enough for the high-pass filters HP1, HP2 and the LMS algorithm to settle. This ensures that modifying the filter characteristic H of the high-pass filters HP1, HP2 does not cause spurious signals in the unprocessed signal US. Since, however, the variable boost H1, H2, H3 is applied to the error signal E and the reference signal R, but not to any signal in the primary signal path, the processing in the signal processor SP is only indirectly affected by the boost. Thus, no modifications need to be made to the signal processing when modifying the filter characteristic H of the high-pass filters HP1, HP2.

The signal processor SP receives the computed frequency spectra FS in the spectrum information signal SI and adapts its processing in dependence hereon. For instance, the frequency spectra FS may be used to detect specific acoustic environments, such as "in car", "speech in noise" etc., which may require special processing, e.g. if the hearing device HD operates as a hearing aid. Such adaptations are well known in the prior art, and any of these may be implemented. The parallel use of the computed frequency spectra FS, i.e. in the control unit CU and in the signal processor SP, saves resources, e.g. power, space and/or costs, in the hearing device HD.

The cut-off frequency FC is preferably selected in the range between 1 kHz and 3 kHz, e.g. about 1.5 kHz, and preferably so that the HF passband comprises the frequency range in which feedback-caused artifacts are likely to occur. Accordingly, the cut-off frequency FC may preferably be chosen as low as e.g. about 600 Hz or even about 300 Hz in hearing devices with relatively high acoustic gain. The boost frequency FB is preferably selected in the range between 1 kHz and 3 kHz, e.g. about 2 kHz, and is preferably higher than the cut-off frequency FC. The boost frequency FB is preferably selected so that it enables compensation of HF roll-off in typical received signals by application of the boost levels H1, H2, H3. The lower-limit frequency FL is preferably selected in the range between 1 kHz and 3 kHz, e.g. about 1 kHz, and is preferably substantially lower than the boost frequency FB. The difference between the individual boost levels H1, H2, H3 in the transfer function H of the high-pass filters HP1, HP2 is preferably selected so that the difference between maximum boost H3 and minimum boost H1 is in the region of 20 dB to 40 dB, or preferably about 30 dB. The number of boost levels H1, H2, H3 may preferably be chosen to provide level steps of e.g. 6 dB or 10 dB. The boost frequency FB and the boost levels H1, H2, H3 are preferably selected in dependence on detection of specific acoustic environments, since the degree and the frequency dependency of HF roll-off in received signals typically vary between different types of acoustic environments. Several methods for detecting acoustic environments are well known in the prior art, and any of these may be implemented.

The processing circuitry PC is preferably implemented as digital circuits operating in the discrete time domain, but any or all parts hereof may alternatively be implemented as analog circuits operating in the continuous time domain. Although shown and described as distinct components, the functional blocks of the processing circuitry PC may be implemented in any suitable combination of hardware, firmware and software and/or in any suitable combination of hardware units. Furthermore, a single hardware unit may execute the operations of several functional blocks in parallel or in interleaved sequence and/or in any suitable combination thereof. The analog-to-digital converter AD and/or the digital-to-analog converter DA may be included in the processing circuitry PC, and the first adder A1 may be located in the signal path between the microphone M and the analog-to-digital converter AD.

Further modifications obvious to the skilled person may be made to the disclosed method and device without deviating from the spirit and scope of the invention. In the following, such modifications are mentioned in a non-limiting way. The combining of the microphone signal MS with the estimated feedback signal EF may take place in any way that yields the same result as the subtraction performed by the first adder A1. For instance, the estimated feedback signal EF may be provided by the first estimation filter FE1 as an inverted signal, which is simply added to the microphone signal MS. The time delays in the cancellation path and in the LF control path may be provided by distinct delay elements D, by the first and second estimation filters FE1, FE2, in which case delay elements D may be omitted, or by a combination hereof. The sign of the noise error signal NE may be inverted without further consequences, since the LMS algorithm operates on the magnitude of the error signal E. The estimation of relative amounts of high- and low-frequency signal content may be based on the main error signal ES or on any other signal, which is derived from the microphone signal MS and/or from the unprocessed signal US. The estimation of relative amounts of high- and low-frequency signal content may be executed within a limited frequency range RL, RH, and the estimation as well as the variation of boost H1, H2, H3 may be executed simultaneously for several individual frequency ranges. Accordingly, the transfer function H of the high-pass filters HP1, HP2 may be modified to compensate for an overall spectral tilt and/or to compensate for variations of the frequency spectrum FS on a smaller scale. The frequency used to separate the high- and low-frequency ranges RL, RH from each other in the computation of the power ratio may deviate from the boost frequency FB above which the variable boost H1, H2, H3 is applied. The reference and error signals R, E may be derived directly or indirectly from the processed signal PS and the unprocessed signal US, respectively. The LMS algorithm may be normalised or non-normalised, and it may further be substituted by or combined with other optimisation algorithms, which may control the estimation filter coefficients with substantially the same result. The invention may be exercised without the functions and/or functional blocks of the LF control path. The noise signal N may be provided by any other suitable type of noise generator, e.g. a white-noise generator the output of which may be modulated with the envelope of the delayed signal DS.

It will be understood that an element referred to as being "connected" or "coupled" to another element can be directly connected or coupled to the other element, or intervening elements may be present, unless expressly stated otherwise. Furthermore, signals may be received directly from the mentioned sources or indirectly via intervening passive or active circuits, such as buffers, inverters, logic gates, transistors etc., without deviating from the spirit and scope of the invention.

The invention is defined by the features of the independent claim(s). Preferred embodiments are defined in the dependent claims. Any reference signs in the claims are intended to be non-limiting for their scope.

Some preferred embodiments have been shown in the foregoing, but it should be stressed that the invention is not limited to these, but may be embodied in other ways within the subject-matter defined in the following claims. For example, the features of the described embodiments may be combined arbitrarily.

The invention claimed is:

1. A method for adaptively suppressing acoustic feedback in a hearing device, the method comprising: receiving an acoustic input signal comprising ambient sounds from the environment and acoustic feedback of an acoustic output signal; converting the acoustic input signalinto a microphone signal; combining the microphone signal with an estimated feedback signal, thereby generating an unprocessed signal; processing the unprocessed signal, thereby generating a processed signal; converting the processed signal into the acoustic output signal; radiating the acoustic output signal into a user's ear canal; applying a first transfer function to the processed signal, thereby generating the estimated feedback signal; applying a second transfer function to the unprocessed signal, thereby generating a main error signal; and modifying the first transfer function in dependence on the main error signal; characterised in that the method further comprises: estimating relative amounts of high- and low-frequency signal content in at least one of the microphone signal and the unprocessed signal; and modifying the second transfer function in dependence on the estimated relative amounts.

2. A method according to claim 1 and further comprising: increasing a high-frequency gain of the second transfer function in dependence on the relative amount of high-frequency signal content decreasing, and vice versa.

3. A method according to claim 1 or 2 and further comprising: modifying the second transfer function by selectively enabling one of a predefined number of filter coefficient sets.

4. A method according to claim 1, and further comprising: temporarily refraining from modifying the first transfer function immediately after modifying the second transfer function.

5. A method according to claim 1, and further comprising: applying the second transfer function to the processed signal, thereby generating a main reference signal; and modifying the first transfer function in dependence on the main reference signal.

6. A method according to claim 5 and further comprising: generating a noise reference signal mainly comprising signal content in a frequency range that is suppressed by the second transfer function; applying the first transfer function to the noise reference signal, thereby generating a noise error signal; modifying the first transfer function in dependence on a combination of the main reference signal and the noise reference signal as well as in dependence on a combination of the main error signal and the noise error signal.

7. A method according to claim 6, the method further comprising: providing high-pass filtering by the second transfer function; generating a noise signal in dependence on the processed signal; and low-pass filtering the noise signal, thereby generating the noise reference signal.

8. A method according to claim 1, and further comprising: computing frequency spectra for at least one of the microphone signal and the unprocessed signal; and estimating the relative amounts of high- and low-frequency signal content in dependence on the computed frequency spectra.

9. A method according to claim 8 and further comprising: for each computed frequency spectrum, determining a desired value of the second transfer function; and modifying the second transfer function in dependence on at least two consecutive desired values.

10. A method according to claim 8 or 9 and further comprising: detecting peaks in the computed frequency spectra; and modifying an adaptation speed of the first transfer function in dependence on the detected peaks.

11. A method according to claim 8, and further comprising: modifying the processing of the unprocessed signal in dependence on the computed frequency spectra.

12. A hearing device comprising a microphone unit, processing circuitry and a speaker unit, the hearing device being adapted to perform the functions of:

receiving an acoustic input signal comprising ambient sounds from the environment and acoustic feedback of an acoustic output signal; converting the acoustic input signal into a microphone signal; combining the microphone signal with an estimated feedback signal, thereby generating an unprocessed signal; processing the unprocessed signal, thereby generating a processed signal; converting the processed signal into the acoustic output signal; radiating the acoustic output signal into a user's ear canal; applying a first transfer function to the processed signal, thereby generating the estimated feedback signal; applying a second transfer function to the unprocessed signal, thereby generating a main error signal; and modifying the first transfer function in dependence on the main error signal; characterised in that the method further comprises: estimating relative amounts of high- and low-frequency signal content in at least one of the microphone signal and the unprocessed signal; and modifying the second transfer function in dependence on the estimated relative amounts;

the microphone unit being arranged to receive the acoustic input signal and adapted to provide the microphone signal, the processing circuitry being connected to receive the microphone signal and adapted to provide the processed signal, and the speaker unit being connected to receive the processed signal and adapted to radiate the acoustic output signal.

13. A hearing device according to claim 12 being further adapted to perform the function of: increasing a high-frequency gain of the second transfer function in dependence on the relative amount of high-frequency signal content decreasing, and vice versa.

14. A hearing device according to claim 12 or 13 being further adapted to perform the function of: modifying the second transfer function by selectively enabling one of a predefined number of filter coefficient sets.

15. A hearing device according to claim 12 being further adapted to perform the function of: temporarily refraining from modifying the first transfer function immediately after modifying the second transfer function.

16. A hearing device according to claim 12 being further adapted to perform the function of: applying the second transfer function to the processed signal, thereby generating a main reference signal; and modifying the first transfer function in dependence on the main reference signal.

17. A hearing device according to claim 16 being further adapted to perform the function of: generating a noise reference signal mainly comprising signal content in a frequency range that is suppressed by the second transfer function; applying the first transfer function to the noise reference signal, thereby generating a noise error signal; modifying the first transfer function in dependence on a combination of the main reference signal and the noise reference signal as well as in dependence on a combination of the main error signal and the noise error signal.

18. A hearing device according to claim 17 being further adapted to perform the function of: providing high-pass filtering by the second transfer function; generating a noise signal in dependence on the processed signal; and low-pass filtering the noise signal, thereby generating the noise reference signal.

19. A hearing device according to claim 12 being further adapted to perform the function of: computing frequency spectra for at least one of the microphone signal and the unprocessed signal; and estimating the relative amounts of high- and low-frequency signal content in dependence on the computed frequency spectra.

20. A hearing device according to claim 19 being further adapted to perform the function of: for each computed frequency spectrum, determining a desired value of the second transfer function; and modifying the second transfer function in dependence on at least two consecutive desired values.

21. A hearing device according to claim 19 or 20 being further adapted to perform the function of: detecting peaks in the computed frequency spectra; and modifying an adaptation speed of the first transfer function in dependence on the detected peaks.

22. A hearing device according to claim 19 being further adapted to perform the function of: modifying the processing of the unprocessed signal in dependence on the computed frequency spectra.

* * * * *